US007024899B2

(12) United States Patent
Klingen et al.

(10) Patent No.: US 7,024,899 B2
(45) Date of Patent: Apr. 11, 2006

(54) ROLL ASSEMBLY FOR A ROLLING MILL

(75) Inventors: Herrmann-Josef Klingen, Moers (DE); Thomas Winterfeldt, Rheinberg (DE); Lothar Lückhof, Herne (DE)

(73) Assignee: SMS Meer GmbH, Monchengladbach (DE)

( * ) Notice: Subject to any disclaimer, the term of this patent is extended or adjusted under 35 U.S.C. 154(b) by 106 days.

(21) Appl. No.: 10/743,548

(22) Filed: Dec. 22, 2003

(65) Prior Publication Data

US 2004/0144148 A1 Jul. 29, 2004

(30) Foreign Application Priority Data

Dec. 24, 2002 (DE) ..... 102 61 057

(51) Int. Cl.
*B21D 3/00* (2006.01)

(52) U.S. Cl. ..... 72/78

(58) Field of Classification Search ..... 72/77, 72/78, 95, 99, 100, 249, 252.5; 492/1, 15, 492/27, 38, 47; 74/413
See application file for complete search history.

(56) References Cited

U.S. PATENT DOCUMENTS

| | | | | |
|---|---|---|---|---|
| 3,388,578 | A * | 6/1968 | Wykes | 72/240 |
| 3,718,020 | A * | 2/1973 | Leitner | 72/78 |
| 4,579,289 | A * | 4/1986 | Siebke | 241/110 |
| 4,587,820 | A * | 5/1986 | Bohmer | 72/78 |
| 4,660,398 | A * | 4/1987 | Jour et al. | 72/100 |
| 5,109,585 | A * | 5/1992 | Kark | 492/2 |
| 5,934,131 | A * | 8/1999 | Shen | 72/252.5 |
| 6,705,978 | B1 * | 3/2004 | Pienmaki et al. | 491/11 |

FOREIGN PATENT DOCUMENTS

| | | |
|---|---|---|
| DE | 30 43 937 | 7/1982 |
| DE | 32 29 201 | 2/1984 |
| DE | 32 30 701 | 2/1984 |
| JP | 57000715 | 1/1982 |

* cited by examiner

*Primary Examiner*—Ed Tolan
(74) *Attorney, Agent, or Firm*—Herbert Dubno

(57) ABSTRACT

A roll shaft assembly especially for a planetary cross roll rolling mill for tubing and the like has the roll shaft and mill roll connected by a conical centering arrangement and a screw, preferably coaxial therewith with the torque transfer being effected by tooth rings on the ends of the shaft and roll and having interdigitating teeth.

17 Claims, 2 Drawing Sheets

ROLL ASSEMBLY FOR A ROLLING MILL

FIELD OF THE INVENTION

Our present invention relates to a roll assembly for a rolling mill, especially for a planetary cross-roll mill in which a roll is detachably connected to a roll shaft and between the roll and roll shaft formations are provided for delivering the driving torque to the roll.

BACKGROUND OF THE INVENTION

In planetary cross-roll mills, usually used for rolling tubing and pipe, the rolls with their conical external configurations or contours are so mounted or arranged on respective roll shafts that a positive transfer of torque from the roll shaft to the roll is possible in spite of the fact that a replacement of the roll is facilitated. The problem of delivery of torque to a rolling mill roll is, of course, more general and it is desirable in other rolling mill applications to be able to separate the roll from the shaft.

One of the ways in which torque has been delivered in the past, especially between a roll shaft and a mill roll has been through the use of a so-called Voith end toothing which couples the roll and the shaft for torque transfer therebetween and is hydraulically clamped through the use of a tension anchor.

In another approach the roll is fastened to the roll shaft by interfitting jaws and held together by a central screw in the roll. Both approaches have disadvantages. The Voith end tooth arrangement utilizing a hydraulically-clamped tension anchor applies high axial forces which must be absorbed in the system. The arrangement is relatively expensive because it requires hollow shafts, tension or draw bars and special rings. The hydraulic tool which is required for clamping and releasing the anchor is likewise expensive and inconvenient to use. It is also a disadvantage that the system must be frequently adjusted and in the case in which certain hydraulic devices are to be used, the draw bar or tension anchor cannot be used.

In the case of jaw-type torque transfer arrangements, the fabrication of the jaws themselves may be expensive. As a rule four uniformly-spaced jaws are employed and must be fabricated to low tolerances. They are subject to high wear and in many cases can be easily overloaded. The bending forces must be taken up by relatively short cylindrical seats which are also subject to wear and may be unduly stressed, especially as the system develops heat in use.

The disassembly of the system is difficult, especially when separation of the parts is required in the hot state. The jaws are wear parts which tend to fail with time and the heat development also affects other parts of this system.

OBJECTS OF THE INVENTION

It is, therefore, the principal object of the present invention to provide a roll assembly, especially for a planetary cross-roll rolling mill, which overcomes the drawbacks of the prior art systems described and can afford optimum torque transfer between the roll and the roll shaft.

Another object of the invention is to provide a roll assembly for the purposes described in which torque transfer and bending-force absorption are optimized while permitting a simple roll replacement or exchange.

It is also an object of this invention to provide a low cost roll and roll shaft assembly which can ensure effective torque transfer as well as simple replacement of the roll.

SUMMARY OF THE INVENTION

These objects are attained, in accordance with the invention in a roll assembly for a rolling mill, especially a roll assembly for a planetary cross-roll rolling mill which comprises:

a roll shaft;

a mill roll driven by the roll shaft; and a first toothed ring fixed on the roll shaft and a second toothed ring interdigitated and coaxial with the first toothed ring and fixed on the mill roll whereby the toothed rings transmit torque between them.

The means for the formfitting transfer of the drive torque is a first tooth or gear ring which is rotationally fixed with the roll shaft and a second gear ring which is rotationally fixed with the roll and such that the two gear rings have interdigitating teeth which couple the two rings for torque transfer between them.

Preferably the two tooth rings are respectively mounted at end regions of the roll shaft and the roll.

According to another feature of the invention the tooth rings can have straight tooth carrying patterns, especially of multiwedge configuration of the type provided in DIN (German Industrial Standard) 5480.

At least one of the tooth rings and preferably both of the tooth rings can be mounted on the respective end of the roll shaft or roll in a rotationally fixed manner by means of pins. Advantageously the axes of the pins are arranged parallel to the axis of the roll shaft or roll.

According to a feature of the invention the roll is centered with respect to the roll shaft at a projection on the one engaging in a recess on the other and both of these formations, namely the projection of the recess can be conical. When the projection is on the shaft and the recess is in the roll, the conical centering structure preferably extends at least 30% of the length of the roll into the latter.

The roll is joined by means of a screw connection with the roll shaft and this screw connection can preferably be a single screw which is coaxial with the roll and the roll shaft.

A seal, preferably an o-ring or like elastomeric sealing element, can be provided between the roll and the roll shaft outwardly of the tooth rings. That seal increases the reliability of the assembly.

The arrangement according to the invention has a number of advantages.

Firstly the interdigitation of the teeth of the two rings ensures a better transfer of torque and bending loads by comparison with the jaw systems of the prior art.

In addition, the roll replacement is easier and quicker than has been the case heretofore. The conical centering arrangement can be separated in a nonblocking or jamming manner, especially when the roll is removed in a nonheated stated, heating of the roll to mount it is not required and simply by loosening the screw, the roll can be separated and the teeth of the rings disengaged. No hydraulic tool is required to pull the roll off the shaft.

The roll is a wear part and can have a simple contour so that it can be easily fabricated. Since the toothed ring on the roll does not wear significantly, it can be simply transferred to a new roll.

An important advantage over systems using the Voith end toothing is that no special axial force is required to separate the roll from the roll shaft. Since the conical recess in the roll can be approximately parallel to the conical outer contour of the roll, there is only a limited danger of cracking. The system is of low cost by comparison with earlier arrangements.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
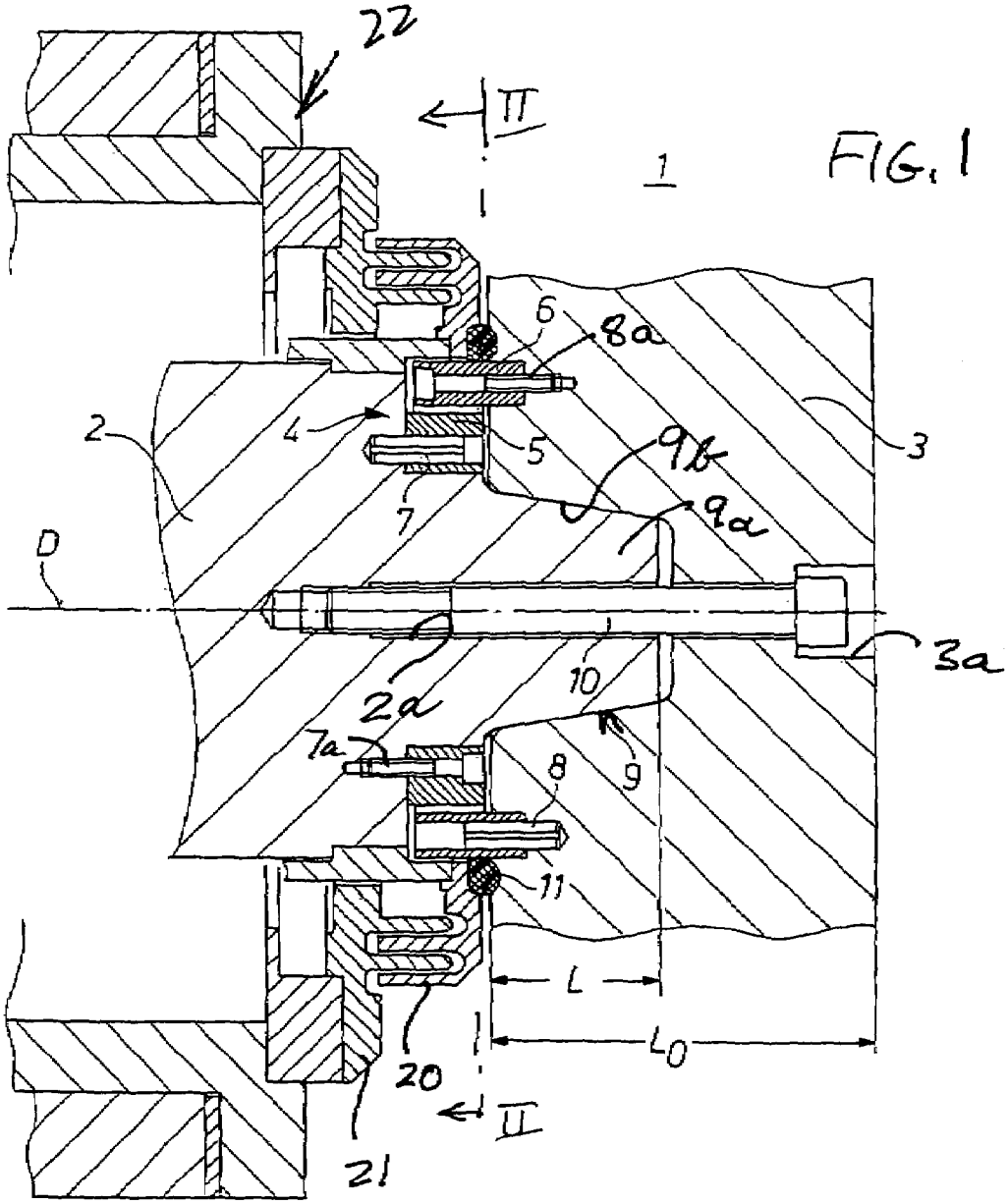
FIG. 1 is an axial cross section through a roll assembly according to the invention and for use in planetary cross roll rolling mills.
Figure 2:
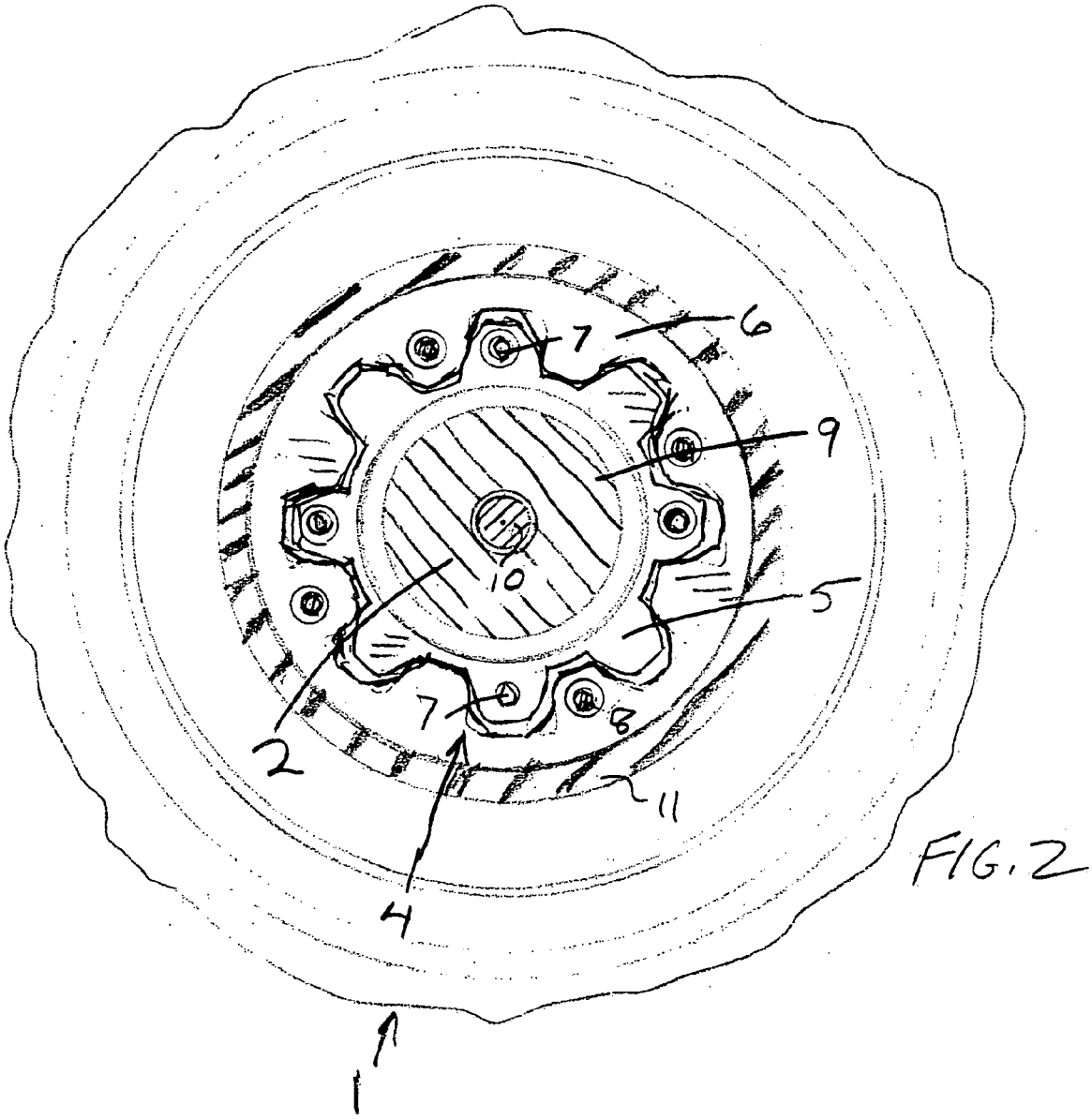
FIG. 2 is a cross sectional view taken along line II—II of FIG. 1.

The assembly 1 shown in FIGS. 1 and 2 has a roll shaft 2 which, at its right hand end illustrated, replaceably carries a roll 3. The centering of the roll 3 on the roll shaft 2 is effected by means of conical centering formation represented generally at 9 and including a conical projection 9*a* on the shaft end 2 and a conical recess 9*b* formed in the roll 3. The roll is attached to the roll shaft 2 by a screw 10 which is countersunk in a recess 3*a* and threadedly engages in a bore 2*a* of the shaft 2. The single screw 10 has its axis coinciding with the common axis D of the shaft 2 and the roll 3 and referred to here as the axis D.

To ensure an effective centering and hence true rotation of the roll 3 with the shaft 2, the length L to which the conical centering formations extend in the roll 3 is at least 30% of the total length L of the roll 3. That, of course, ensures that the bending forces on the roll 3 can be fully taken up by the relatively long conical projection 9*a*.

Means 4 are provided for a formfitting coupling of the ends of the roll shaft 2 and the roll 3 to transform the driving torque from the roll shaft 2 to the roll 3. This means is comprised of two tooth rings 5 and 6 which have radially interdigitating teeth. The tooth rings 5 and 6 are so configured that they conform to the toothed or spline arrangement illustrated and described in (German Industrial Standard) DIN 5480.

The first tooth ring 5 is rotationally fixed on the end of the roll shaft 2 by pins 7 and, if desired, by cap screws 7*a*. The second tooth ring 6 is affixed to the juxtaposed end of the roll 3 by pins 8 and, if desired, by cap screws 8*a*. The pins 7 and 8 have their axes parallel to the rotation axis D. An elastomeric seal 11 is provided in a recess of the roll 3 and can be compressed between the roll and a labyrinth seal cover 20 cooperating with a labyrinth seal plate 21 of a housing 22 in which the shaft 2 is journaled.

We claim:

1. A roll assembly for a rolling mill comprising:

a roll shaft having an axis;

a mill roll driven by said roll shaft; and a first toothed ring fixed on said roll shaft and a second toothed ring interdigitated and coaxial with said first toothed ring and fixed on said mill roll whereby said toothed rings transmit torque between them, said roll being a roll of a planetary cross-roll mill and said first toothed ring being mounted on an end face of an axial end of said roll shaft and said second toothed ring being mounted on an end face of an axial end of said mill roll, the teeth of said toothed rings extending axially with respect to said axis and perpendicular to said end faces.

2. The roll assembly defined in claim 1 wherein the teeth of said toothed rings are in a straight-tooth gear pattern.

3. The roll assembly defined in claim 2 wherein at least one of said toothed rings is affixed to the respective end face by a plurality of pins.

4. The roll assembly defined in claim 3 wherein said pins have axes parallel to a common axis of said toothed rings.

5. The roll assembly defined in claim 4, further comprising generally conical centering formations centering said shaft with respect to said roll.

6. The roll assembly defined in claim 5 wherein said conical centering formations include a conically tapered projection on one of said axial ends fitting into a conically tapered recess on the other of said axial end and receiving said projection.

7. The roll assembly defined in claim 6 wherein said projection is formed on said shaft and extends into said roll to a depth which is at least 30% of the axial length of said roll.

8. The roll assembly defined in claim 7, further comprising a screw connection between said roll and said shaft.

9. The roll assembly defined in claim 8 wherein said screw connection has a single screw coaxial with said shaft and said roll.

10. The roll assembly defined in claim 9, further comprising a seal between the roll and the shaft.

11. The roll assembly defined in claim 1 wherein at least one of said toothed rings is affixed to the respective end face by a plurality of pins.

12. The roll assembly defined in claim 11 wherein said pins have axes parallel to a common axis of said toothed rings.

13. The roll assembly defined in claim 1, further comprising generally conical centering formations centering said shaft with respect to said roll.

14. The roll assembly defined in claim 13 wherein said conical centering formations include a conically tapered projection on one of said axial ends fitting into a conically tapered recess on the other of said axial end and receiving said projection.

15. The roll assembly defined in claim 14 wherein said projection is formed on said shaft and extends into said roll to a depth which is at least 30% of the axial length of said roll.

16. The roll assembly defined in claim 1, further comprising a single screw coaxial with said shaft and said roll for connecting said roll to said shaft.

17. The roll assembly defined in claim 1, further comprising a seal between the roll and the shaft.

* * * * *